US009097081B2

(12) United States Patent
Biddick

(10) Patent No.: US 9,097,081 B2
(45) Date of Patent: Aug. 4, 2015

(54) DIFFERENTIAL PRESSURE ACTUATOR

(75) Inventor: David James Biddick, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 793 days.

(21) Appl. No.: 13/290,304

(22) Filed: Nov. 7, 2011

(65) Prior Publication Data

US 2013/0112422 A1 May 9, 2013

(51) Int. Cl.

| | |
|---|---|
| ***E21B 34/00*** | (2006.01) |
| ***E21B 34/06*** | (2006.01) |
| ***E21B 23/04*** | (2006.01) |
| ***E21B 41/00*** | (2006.01) |

(52) U.S. Cl.
CPC ..... *E21B 23/04* (2013.01); *E21B 41/00* (2013.01)

(58) Field of Classification Search
CPC ..... E21B 23/04; E21B 24/03; E21B 34/06; E21B 34/08; E21B 34/10; E21B 41/00
USPC ..... 166/319, 321, 332.1; 251/12, 61, 62
See application file for complete search history.

(56) References Cited

U.S. PATENT DOCUMENTS

| | | | | |
|---|---|---|---|---|
| 3,002,526 | A | 10/1961 | Terral | |
| 4,841,845 | A * | 6/1989 | Beullens | 92/92 |
| 5,029,646 | A | 7/1991 | Blizzard, Jr. | |
| 5,368,108 | A | 11/1994 | Aldred et al. | |
| 5,564,675 | A | 10/1996 | Hill, Jr. et al. | |
| 6,073,905 | A * | 6/2000 | Wilson | 251/61 |
| 6,315,047 | B1 | 11/2001 | Deaton et al. | |
| 6,899,313 | B2 * | 5/2005 | Carrillo et al. | 251/129.08 |
| 2006/0266961 | A1 * | 11/2006 | Frenkel | 251/61 |
| 2008/0060801 | A1 * | 3/2008 | Ocalan | 166/66.6 |
| 2009/0242206 | A1 | 10/2009 | Goughnour et al. | |
| 2013/0112422 | A1 * | 5/2013 | Biddick | 166/373 |

* cited by examiner

*Primary Examiner* — Daniel P Stephenson
(74) *Attorney, Agent, or Firm* — David J. Groesbeck; Brandon Clark

(57) ABSTRACT

A technique facilitates actuation of a variety of tools in many types of environments. The actuation technique employs a closed conduit, such as a closed tube, arranged in a curvilinear structure. By applying a differential pressure to the closed conduit, the curvature of the curvilinear structure is changed. This change can be used to actuate a corresponding tool between desired operational positions.

19 Claims, 3 Drawing Sheets

DIFFERENTIAL PRESSURE ACTUATOR

BACKGROUND

A variety of actuators are used in downhole well systems and other types of systems to actuate tools between operational positions. The actuator is coupled to a movable element of a corresponding tool to enable controlled shifting of the tool between the operational positions. In many downhole, well applications, for example, hydraulic actuators are employed and comprise a movable piston which can be shifted by applying suitable hydraulic pressure. Plastic and/or elastomeric materials are used to form a seal between the piston and a surrounding cylindrical wall of the actuator, but such materials may be susceptible to degradation in certain high temperature or otherwise deleterious downhole environments.

SUMMARY

In general, the present disclosure provides an actuation technique which can be utilized to actuate a variety of tools. The actuation technique employs a closed conduit, such as a closed tube, arranged in a curvilinear structure. By applying a differential pressure to the closed conduit, the curvature of the curvilinear structure is changed. This change can be used to actuate a corresponding tool between desired operational positions.

BRIEF DESCRIPTION OF THE DRAWINGS

Certain embodiments of the differential pressure actuator will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a differential pressure actuator system which may be used in a wide variety of environments and with many types of tools. The differential pressure actuator system utilizes a closed conduit, such as a closed tube, which has a curvilinear shape. As the pressure inside the closed conduit increases relative to the pressure acting on the exterior of the closed conduit, the curves of the closed conduit tend to straighten. This tendency to straighten is useful for applying an actuation force. For example, the closed conduit can be used to drive a movable member coupled to a tool which is actuated between operational positions.

Although the differential pressure actuator system is useful in many downhole environments for actuating downhole tools, the system may be used in many other types of applications. The design of the differential pressure actuator system also enables construction of an all metal actuator system which can be useful in harsh environments that would otherwise detrimentally affect the life of plastic/elastomeric seals and components. By way of example, the closed conduit may be constructed from a metal material, such as a steel material. In some environments, the closed conduit may be constructed from stainless steel to limit corrosion. However, the closed conduit may be made from a variety of other metals and other types of materials depending on the parameters of a given environment and application.

Figure 1:
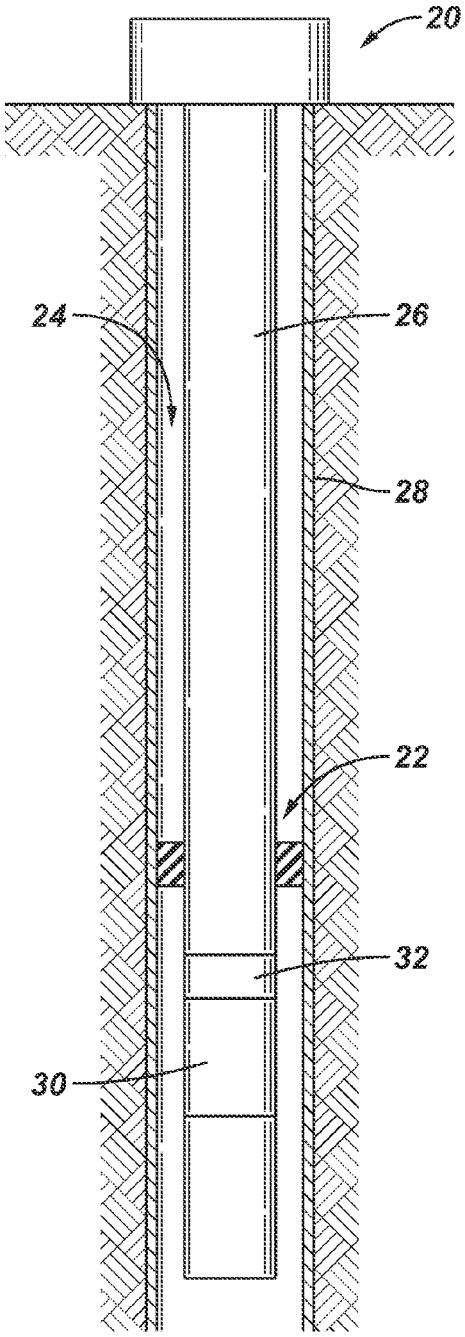
FIG. 1 is a schematic illustration of an example of an actuator and corresponding tool employed in a downhole, well application, according to an embodiment of the disclosure.

Referring generally to FIG. 1, an example of one type of application utilizing the differential pressure actuator system is illustrated. The example is provided to facilitate explanation, and it should be understood that the differential pressure actuator system may be used in a variety of other environments and applications, including non-well related applications. In FIG. 1, an embodiment of a well system 20 is illustrated as comprising downhole equipment 22, e.g. a well completion, deployed in a wellbore 24 via a conveyance 26, e.g. production tubing or coiled tubing. Downhole equipment 22 may include a wide variety of components, depending in part on the specific application, geological characteristics, and well type. In the example illustrated, the wellbore 24 is substantially vertical and lined with a casing 28. However, various well completions and other embodiments of downhole equipment 22 may be used in a well system having many types of wellbores, including deviated, e.g. horizontal, single bore, multilateral, single zone, multi-zone, cased, uncased (open bore), or other types of wellbores.

In the example illustrated, downhole equipment 22 comprises a tool 30 which may be actuated between different operational positions. The tool 30 is coupled with an actuator 32 which is in the form of a differential pressure actuator. By way of example, tool 30 may comprise a valve, such as a ball valve or sliding sleeve valve, to control fluid flow along, into and/or out of downhole equipment 22. However, tool 30 also may comprise many other types of actuatable tools which may be used in downhole applications or other types of applications.

Figure 2:
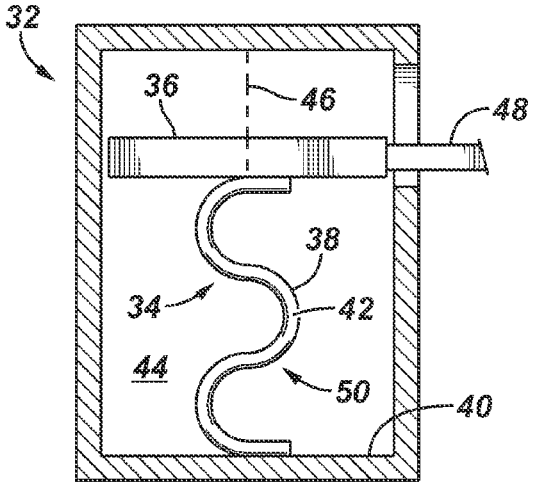
FIG. 2 is a schematic illustration of an example of a differential pressure actuator, according to an embodiment of the disclosure.

Referring generally to FIG. 2, a schematic example of one type of differential pressure actuator 32 is illustrated. The differential pressure actuator 32 comprises a differential pressure actuator member 34 having a movable member 36 cooperating with a closed conduit 38. By way of example, the closed conduit 38 is coupled between the movable member 36 and an anchor member 40. The closed conduit 38 is closed in the sense that it enables creation of a pressure differential between an interior 42 of the closed conduit and an exterior region 44 along the outside of closed conduit 38. The closed conduit 38 has a shape which enables changes in length along a longitudinal axis 46 upon changes in the pressure differential between the interior 42 and the exterior region 44 of the closed conduit 38. The longitudinal axis 46 may be the linear actuation axis along which a coupling member 48 is moved by movable member 36 to actuate tool 30 to a desired operational position.

The closed conduit shape which enables changes in length may be a curved shape. As pressure rises in interior 42 relative to exterior 44, the curved sections of the closed conduit tend to straighten which changes the overall length of the closed conduit along the longitudinal axis 46. By way of example, the closed conduit 38 may be formed as a curvilinear structure 50 having a curvilinear shape. By changing the pressure differential between the interior 42 and exterior 44, the curvilinear structure 50 tends to straighten or relax the curved shape, thus creating corresponding changes in the overall length of curvilinear structure 50 along longitudinal axis 46. These changes in length along longitudinal axis 46 cause corresponding movement of movable member 36 and thus actuation of tool 30. However, the curvilinear structure 50 may be designed to undergo changes other than movement along longitudinal axis 46, e.g. movement along a curved path.

Figure 3:
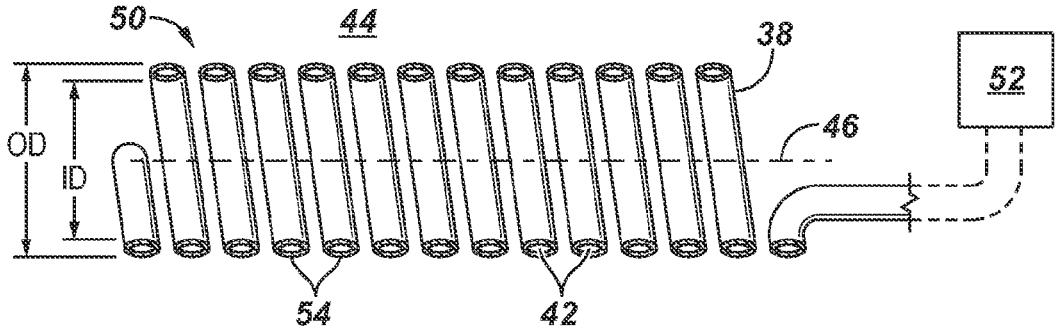
FIG. 3 is a schematic illustration of another example of a differential pressure actuator, according to an embodiment of the disclosure.

Referring generally to FIG. 3, another example of closed conduit 38 is illustrated as arranged in a different curvilinear structure 50. In this embodiment, closed conduit 38 is coupled to a pressure source 52 which is used to control the pressure level in the interior 42. The curvilinear structure 50 is illustrated in the form of a coil of tubing 54 oriented to coil about the longitudinal axis 46. The longitudinal axis 46, in turn, is oriented to serve as the linear actuation axis for facilitating actuation of tool 30.

In this example, controlled pressure is applied via pressure source 52 to the interior 42 of coil 54, and the exterior 44 is exposed to the ambient environment. If the outside pressure along exterior 44 is greater than the pressure of interior 42, the coil 54 tends to shrink in mean diameter. Because the tubing length in coil 54 is fixed, the longitudinal length of the overall curvilinear structure grows along the longitudinal axis 46. If, on the other hand, the pressure along interior 42 is greater than along exterior 44, the opposite occurs and the coil 54 tends to shorten along longitudinal axis 46. This change in axial length along longitudinal axis 46, due to changes in the differential pressure between interior 42 and exterior region 44, can be used to actuate tool 30. By way of example, tool 30 may be actuated between operational positions by shifting sleeves or pistons within tool 30.

Figure 4:
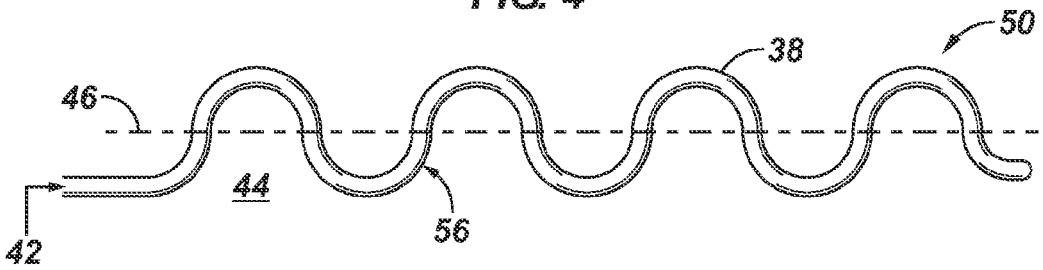
FIG. 4 is a schematic illustration of another example of a differential pressure actuator, according to an embodiment of the disclosure.

Another embodiment of closed conduit 38 and curvilinear structure 50 is illustrated in FIG. 4. In this example, the curvilinear structure 50 extends along longitudinal axis 46. The curvilinear structure 50 may lie generally flat along axis 46 or it may be curved about axis 46 when viewed from an axial end of the curvilinear structure 50. Additionally, the closed conduit 38 may be arranged in an undulating shape extending substantially along a plane oriented in the linear actuation direction defined by longitudinal axis 46. In this example, a higher pressure along interior 42 relative to the pressure along exterior region 44 causes the curvilinear structure 50 to lengthen along longitudinal axis 46. Conversely, a relatively lower pressure along interior 42 causes shortening of the structure along longitudinal axis 46. As with other embodiments, the surface area on the outside of the curvilinear structure is greater than on the inside and the force imbalance due to differential pressure causes displacement. It should be noted that in any of these embodiments, the pressure differential can be changed by adjusting the pressure on exterior region 44 and/or in interior 42. In downhole applications, for example, the pressure acting on exterior region 44 can be adjusted by increasing or decreasing the pressure applied along an annulus or along a another suitable wellbore passage to the exterior region 44.

Figure 5:
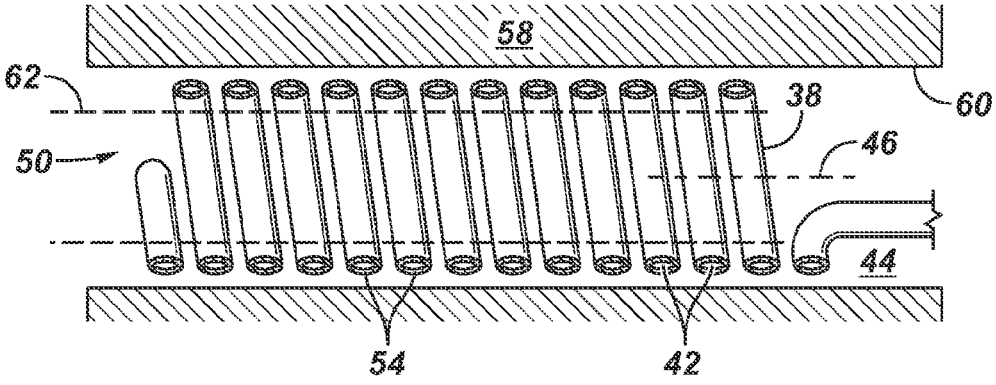
FIG. 5 is a schematic illustration of another example of a differential pressure actuator, according to an embodiment of the disclosure.

In some applications, the stiffness of closed conduit 38 is sufficient to utilize curvilinear structure 50 without support. However, other applications benefit from providing support structures along the closed conduit 38. FIG. 5 illustrates an example of how coil 54 can be constrained along both its inside diameter and its outside diameter. In this example, a housing 58 having a suitable interior surface 60, such as a cylindrical interior surface, is deployed along the outside diameter of the coil 54. An internal support structure 62, such as a mandrel, is deployed along an interior of the coil 54 within the internal diameter of the coil. The housing 58 and internal support structure 62 ensure consistent and repeated actuation of the curvilinear structure 50 without collapse or damage. The coil shape 54 of curvilinear structure 50 may be suitable for a variety of downhole applications because downhole tools often are tubular in shape. The coil arrangement of closed conduit 38 often fits well in the annular design space available due to the tubular shape of the downhole equipment 22.

Figure 6:
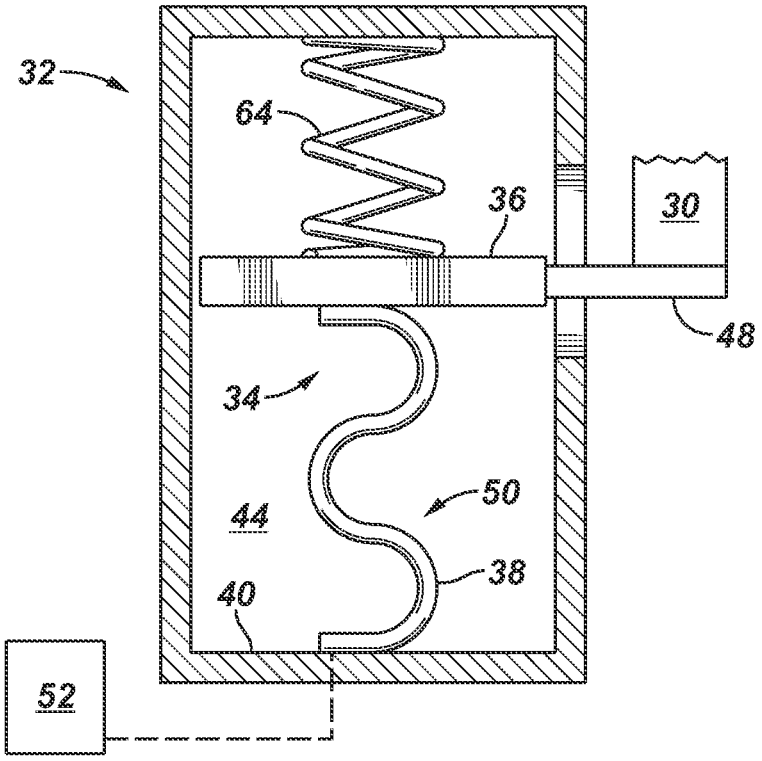
FIG. 6 is a schematic illustration of another example of a differential pressure actuator, according to an embodiment of the disclosure.

Depending on the application, resilient members can be used to provide a bias against movement of movable member 36 in a given direction. As illustrated in FIG. 6, for example, a resilient member 64 is positioned to act against movement of movable member 36 during lengthening of the curvilinear structure 50 to actuate tool 30. Resilient member 64 may comprise a mechanical spring, gas spring, resilient material, or other suitable structures or materials to provide the desired biasing force. The resilient member or members 64 help return the movable member 36 to an initial position, a default position, or another operational position of both the differential pressure actuator 32 and the tool 30. In some applications, additional resilient members 64 may be used to provide additional force in both directions of movement along longitudinal axis 46. Also, the differential pressure actuator 32 could be used as a compensator to, for example, sense ambient conditions and to relieve pressure acting on a tool.

Figure 7:
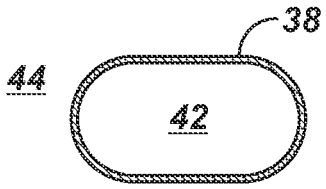
FIG. 7 is a schematic illustration of an example of a closed conduit cross-section which can be used in the closed conduit of the differential pressure actuator, according to an embodiment of the disclosure.
Figure 8:
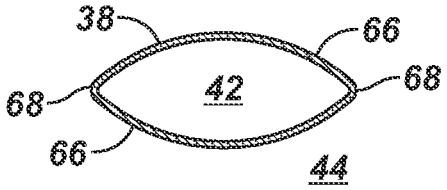
FIG. 8 is a schematic illustration of another example of a closed conduit cross-section which can be used in the differential pressure actuator, according to an embodiment of the disclosure.
Figure 9:
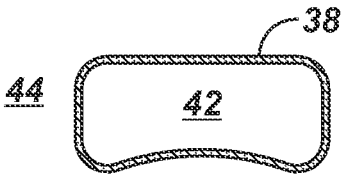
FIG. 9 is a schematic illustration of another example of a closed conduit cross-section which can be used in the differential pressure actuator, according to an embodiment of the disclosure.

Referring generally to FIGS. 7-9, several examples of cross-sectional configurations of the closed conduit 38 are illustrated. In many applications, the closed conduit 38 is constructed with a cross-section having a high aspect ratio. Generally, aspect ratio may be defined as the ratio of the longest measurable dimension in cross-section to the shortest measurable dimension in cross-section. For example, a circular cross-section has an aspect ratio of one. Therefore, high aspect ratio cross-sectional shapes of closed conduit 38 are shapes with an aspect ratio greater than one, e.g. shapes other than what is nominally circular tubing.

In FIG. 7, for example, the cross-sectional configuration of closed conduit 38 is a generally flattened circle in the form of an oval or an ellipse having a long dimension generally perpendicular to a short dimension to create the high aspect ratio. The relatively flat configuration can be used to save space while also facilitating movement of member 36 when the curvilinear structure 50 is subjected to pressure differentials. Another flattened circular shape is illustrated in FIG. 8 in which the cross-sectional shape has curved sections 66 connected by creased regions 68. However, the cross-sectional configuration of closed conduit 38 may have a variety of other types of shapes, including rectangular shapes, such as the generally rectangular but asymmetrical shape represented in FIG. 9.

Figure 10:
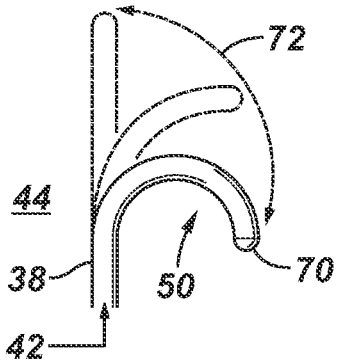
FIG. 10 is a schematic illustration of another example of a differential pressure actuator, according to an embodiment of the disclosure.

Another embodiment of closed conduit 38 and curvilinear structure 50 is illustrated in FIG. 10. In this example, the curvilinear structure 50 comprises a translating end 70 positioned at the end of a curved section of curvilinear structure 50. A higher pressure along interior 42 relative to the pressure along exterior region 44 causes the curvilinear structure 50 to straighten and to move translating end 70 along a curved path 72. Conversely, a relatively lower pressure along interior 42 causes the curvilinear structure 50 to curl and to move the translating end 70 in an opposite direction along curved path 72. The movement of translating end 70 can be used to actuate a device, such as the downhole tool 30. As with other embodiments, the surface area on the outside of the curvilinear structure 50 is greater than on the inside and the force imbalance due to differential pressure causes displacement.

The various embodiments of closed conduit 38 and curvilinear structure 50 may be employed in many configurations. For example, a plurality of the curvilinear structures 50 may be combined to provide a plurality of actuators acting independently or in concert. In other applications, a plurality of the curvilinear structures may be used in opposition to each other, in parallel with each other, in series with each other, and/or acting on different members to perform different actions. In wellbore applications, one side of the curvilinear actuator structure 50 may be exposed to the annulus or bore. In some applications, the curvilinear actuator structure 50 may be in contact with or used in cooperation with a charged system, an atmospheric chamber, or a compensator which is balanced to the annulus, bore, and/or a communication line.

Regardless of the specific cross-sectional shape of closed conduit 38 or of its specific curvilinear structure 50, the differential pressure actuation member 34 may be employed in a variety of tools for use in many types of environments, including harsh environments. As discussed above, the structure and function of the closed conduit 38 allows the conduit 38 to be formed from a metal material, such as steel, e.g. stainless steel. This, in turn, allows the entire differential pressure actuator 32 to be formed from metal to create an all metal actuator that does not suffer from high temperature environments, various chemical environments, or high-cycle usage. The closed nature of conduit 38 also enables the hydraulic pressure signal to be isolated from surrounding fluid in, for example, downhole applications.

However, the components of differential pressure actuator 32, of tool 30 and of the overall system, e.g. well system 20, can be adjusted to accommodate a variety of structural, operational, and/or environmental parameters. For example, closed conduit 38 can be formed from metals or other materials depending on the specific application and environment. A wide variety of tools 30, including many types of valves, may be actuated by the differential pressure actuator 32. Additionally, the size, cross-sectional shape, curvilinear structure, and orientation of the closed conduit 38 may vary according to the design parameters of the actuator and/or according to the desired functionality of the actuator. Additional closed conduits 38 may be added to change the level of force applied and/or to adjust the direction or directions of force application. The specific components and arrangements of components within the differential pressure actuator 32 and in the tool 30 may be modified to accommodate a wide variety of applications and environments.

Although only a few embodiments of the differential pressure actuator system have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a wellbore, comprising:

a downhole tool which may be mechanically transitioned between operational states; and an actuator coupled to the downhole tool to transition the downhole tool between the operational states, the actuator comprising a differential pressure actuator member having a closed conduit arranged in a curvilinear shape such that increasing the pressure within the closed conduit relative to pressure acting on an exterior of the closed conduit causes the closed conduit to change the curvilinear shape in a manner that transitions the downhole tool.

2. The system as recited in claim 1, wherein increasing the pressure within the closed conduit relative to pressure acting on the exterior of the closed conduit causes the curvilinear shape to change in overall length along a linear actuation axis.

3. The system as recited in claim 2, wherein decreasing the pressure within the closed conduit relative to pressure acting on the exterior of the closed conduit causes the curvilinear shape to change in overall length in an opposite direction along the linear actuation axis.

4. The system as recited in claim 2, wherein the curvilinear shape is an undulating shape extending axially along the linear actuation axis.

5. The system as recited in claim 4, wherein the closed conduit is constrained between a mandrel within the coil shape and a cylindrical housing external to the coil shape.

6. The system as recited in claim 2, wherein the downhole tool comprises a valve which may be actuated between open and closed positions by changing the overall length of the curvilinear shape along the linear actuation axis.

7. The system as recited in claim 1, wherein the actuator comprises only metal components.

8. The system as recited in claim 1, wherein closed conduit is formed from steel.

9. The system as recited in claim 1, wherein the cross-section of the closed conduit has the shape of a flattened circle.

10. The system as recited in claim 1, wherein the curvilinear shape is a coil shape.

11. A method, comprising:

arranging a closed conduit in a curvilinear shape;

coupling the closed conduit to a movable member of an actuator to enable movement of the movable member by changing a pressure differential between an interior and exterior of the closed conduit; and providing the closed conduit with a cross-section having a high aspect ratio.

12. The method as recited in claim 11, further comprising coupling the movable member of the actuator to a downhole well tool, and pressurizing the interior of the closed conduit to change the closed conduit length along a linear actuation axis to transition the downhole well tool to a first operational position.

13. The method as recited in claim 12, further comprising releasing pressure from the interior of the closed conduit to change the closed conduit length in an opposite direction along the linear actuation axis to transition the downhole well tool to a second operational position.

14. The method as recited in claim 11, wherein arranging comprises arranging the closed conduit into a coil shape.

15. The method as recited in claim 11, further comprising coupling the closed conduit to a pressure source.

16. The method as recited in claim 11, further comprising forming the closed conduit from a metal material.

17. A differential pressure actuator system, comprising:

an all metal actuator comprising a movable member, an anchor member, and a closed conduit coupled between the anchor member and the movable member, the closed conduit having a shape which enables changes in length in a longitudinal direction upon changes in the pressure differential between an interior and exterior of the closed conduit.

18. The differential pressure actuator system as recited in claim 17, further comprising a well tool coupled to the all metal actuator.

19. The differential pressure actuator system as recited in claim 18, wherein the closed conduit is arranged in a curvilinear shape with a cross-section having a high aspect ratio shape.

* * * * *